US005918959A

United States Patent [19]

Lee

[11] Patent Number: 5,918,959

[45] Date of Patent: Jul. 6, 1999

[54] FOODSTUFF STORING DEVICE FOR A REFRIGERATOR

[75] Inventor: Yong-Kweon Lee, Incheon, Rep. of Korea

[73] Assignee: Daewoo Electronics Co., Ltd., Rep. of Korea

[21] Appl. No.: 08/955,301

[22] Filed: Oct. 21, 1997

[30] Foreign Application Priority Data

Dec. 30, 1996 [KR] Rep. of Korea ..... 96-76232

[51] Int. Cl.[6] ..... A47B 96/04

[52] U.S. Cl. ..... 312/404; 312/334.23; 312/334.26; 312/330.1; 312/408

[58] Field of Search ..... 312/401, 404, 312/408, 324.23, 324.26, 330.1

[56] References Cited

U.S. PATENT DOCUMENTS

| | | | |
|---|---|---|---|
| 2,801,146 | 7/1957 | Mikulas | 312/334.23 X |
| 2,962,183 | 11/1960 | Rill, Jr. et al. | 312/401 X |
| 5,299,863 | 4/1994 | Albright, Jr. | 312/404 |
| 5,366,284 | 11/1994 | Baker et al. | 312/404 |
| 5,540,492 | 7/1996 | Dasher et al. | 312/404 |
| 5,725,294 | 3/1998 | Froelicher | 312/401 |

*Primary Examiner*—Peter M. Cuomo
*Assistant Examiner*—Stephen Vu
*Attorney, Agent, or Firm*—Pillsbury Madison & Sutro, LLP

[57] ABSTRACT

A foodstuff storing device for a refrigerator. The device comprises a projection formed at a lower surface of the shelf, a partition member for separating a vegetable compartment into two chambers, two vegetable boxes which are slidably inserted into the two chambers respectively and guiding members provided at a inside wall of a refrigerating compartment for guiding the vegetable boxes. The partition member comprises a coupling member fixedly assembled with the projection, a supporting member separating the vegetable compartment into the two chambers, and rollers mounted on the supporting member so as to allow the vegetable boxes to be slidably supported thereon. By the rollers installed at the two boxes, the supporting member and guiding members, the sliding movement of the boxes is facilitated. The device stores different types of foodstuffs in separate vegetable boxes, thereby avoiding contamination of the foodstuffs and efficiently maintain freshness of the foodstuffs by selectively drawing out the vegetable boxes.

11 Claims, 3 Drawing Sheets

200

FOODSTUFF STORING DEVICE FOR A REFRIGERATOR

BACKGROUND OF THE INVENTION

1. Field of the Invention

The present invention relates to a refrigerator, and more particularly to a device for storing a foodstuff for a refrigerator.

2. Description of the Prior Art

Generally, refrigerators are used to store foodstuffs at a low temperature in order to maintain freshness of the foodstuffs. They generally comprise a compressor which compresses and circulates a liquid-phase refrigerant, an evaporator which causes a pressure drop of the liquid-phase refrigerant so that the refrigerant is evaporated, thereby generating a chilled air, and a condenser which condenses the vapor-phase refrigerant, thereby changing the vapor-phase refrigerant into liquid-phase refrigerant and which circulates the liquid-phase refrigerant to the compressor. The chilled air generated by the evaporator is introduced into a refrigerating compartment by a fan.

Generally, a refrigerator comprises a refrigerating compartment for storing foodstuffs at a relatively low temperature, and a freezer compartment for storing foodstuffs to be frozen such as meats or ice. The refrigerating compartment is formed at a lower portion thereof with a vegetable compartment in which a separate vegetable box is provided. The vegetable compartment stores vegetables or fruits. The vegetable compartment is located at a lower portion of the refrigerating compartment such that the vegetable compartment is far away from the evaporator generating a chilled air, thereby preventing vegetables and fruits from being frozen by the chilled air.

FIG. 1 illustrates a conventional refrigerator 100 having a vegetable box. Referring to FIG. 1, the refrigerator 100 is formed at the inside thereof with a refrigerating compartment 10. The refrigerating compartment 10 is protrudingly formed at the inner side walls thereof with at least one pair of ribs 14 which are positioned opposite to each other. Shelves are slidably assembled into the pair of ribs 14, thereby supporting foodstuffs thereon. A vegetable compartment 15 is defined by a shelf 18 which is inserted into the lowest pair of ribs 14 formed on the inner wall of the refrigerator 100. A couple of guiding members 16 for guiding a vegetable box 20 are formed at both side walls of refrigerating compartment 10 below the shelf 18 apart from the shelf 18 by a predetermined distance.

The vegetable box 20 is formed at a top surface thereof with an opening 21 forming a storing space 22, and is integrally formed at the upper circumference thereof with a frame 24 extending outward with respect to the vegetable box 20. The frame 24 is formed at both outer sides thereof with grooves 26. The grooves 26 are formed at the center thereof with shafts 28 which horizontally extend so that rollers 30 are rotatably inserted around the shafts 28.

Grooves 26 are formed at both edges thereof, with latching grooves 27. And latches 40, which are formed at both edges thereof with bending parts 48, are provided so that bending parts 48 are latched to latching grooves 27, thereby preventing the rollers 30 from leaving from the shafts 28. At this time, the latches 40 are made of resilient materials so that the bending parts 48 are press-fitted into the latching grooves 27.

Since the rollers 30, which are assembled to both sides of the vegetable box 20, are rotatably supported on the guide members 16, the vegetable box 20 is easily inserted/withdrawn into/from the vegetable compartment 15.

However, since different types of foodstuffs are stored in one storing space, the different types of foodstuffs make contact with each other so that contamination of the foodstuffs occur. Also, when the user draws out the vegetable box 20 in order to take out one foodstuff, the other foodstuff stored in the vegetable box 20 is also exposed to the ambient air so that freshness of the foodstuffs is lost.

SUMMARY OF THE INVENTION

The present invention is intended to overcome the above described disadvantages. Therefore, it is an object of the present invention to provide a foodstuff storing device for a refrigerator which separately stores different types of foodstuffs and has vegetable boxes which slide independently with respect to each other.

In order to achieve the above object of the present invention, there is provided a foodstuff storing device for a refrigerator comprising:

- a shelf provided at a first predetermined position within the refrigerating compartment for forming a vegetable compartment at a lower portion of the refrigerating compartment;
- at least one projection which is downwardly and protrudingly formed at a second predetermined position of a lower surface of the shelf and extends from a front end to a rear end of the shelf;
- at least one partition member for separating the vegetable compartment into at least two chambers, the partition member being coupled to the projection;
- a box section for storing a foodstuff, the box section being slidably inserted into the chamber;
- a first guiding member for guiding a sliding movement of the box section, the first guiding member being provided at a first inside wall of the refrigerating compartment below the shelf; and,
- a second guiding member for guiding a sliding movement of the box section, the second guiding member being provided at a second inside wall of the refrigerating compartment below the shelf, the second inside wall being opposite to the first inside wall.

According to a preferred embodiment of the present invention, one projection is provided at a center portion of the shelf, one partition member is provided so that the vegetable compartment is separated into a first chamber and a second chamber, and the box section includes a first box and a second box which are slidably inserted into the first and the second chambers, respectively.

The partition member comprises a coupling member which is fixedly assembled with the projection, a supporting member which is integrally formed at a lower end of the coupling member and extends to a bottom wall of the refrigerating compartment for separating the vegetable compartment into the first and the second chambers, and first and second rollers which are rotatably mounted on a front portion of a top surface of the supporting member so as to allow the first and second boxes to be slidably supported thereon.

Rollers are rotatably installed at both sides of the first and second boxes and also at the front portions of the first and second guiding member, thereby facilitating the withdrawing and inserting of the first and second boxes.

The foodstuff storing device for a refrigerator according to the present invention has advantages that it can store different types of foodstuffs in different vegetable boxes, thereby avoiding the contamination of the foodstuffs, and that it can efficiently maintain freshness of the foodstuffs by selectively drawing out the vegetable box storing a desired foodstuff.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Hereinafter, a foodstuff storing device for a refrigerator according to a preferred embodiment of the present invention will be explained in more detail with reference to the accompanying drawings.

Figure 1:
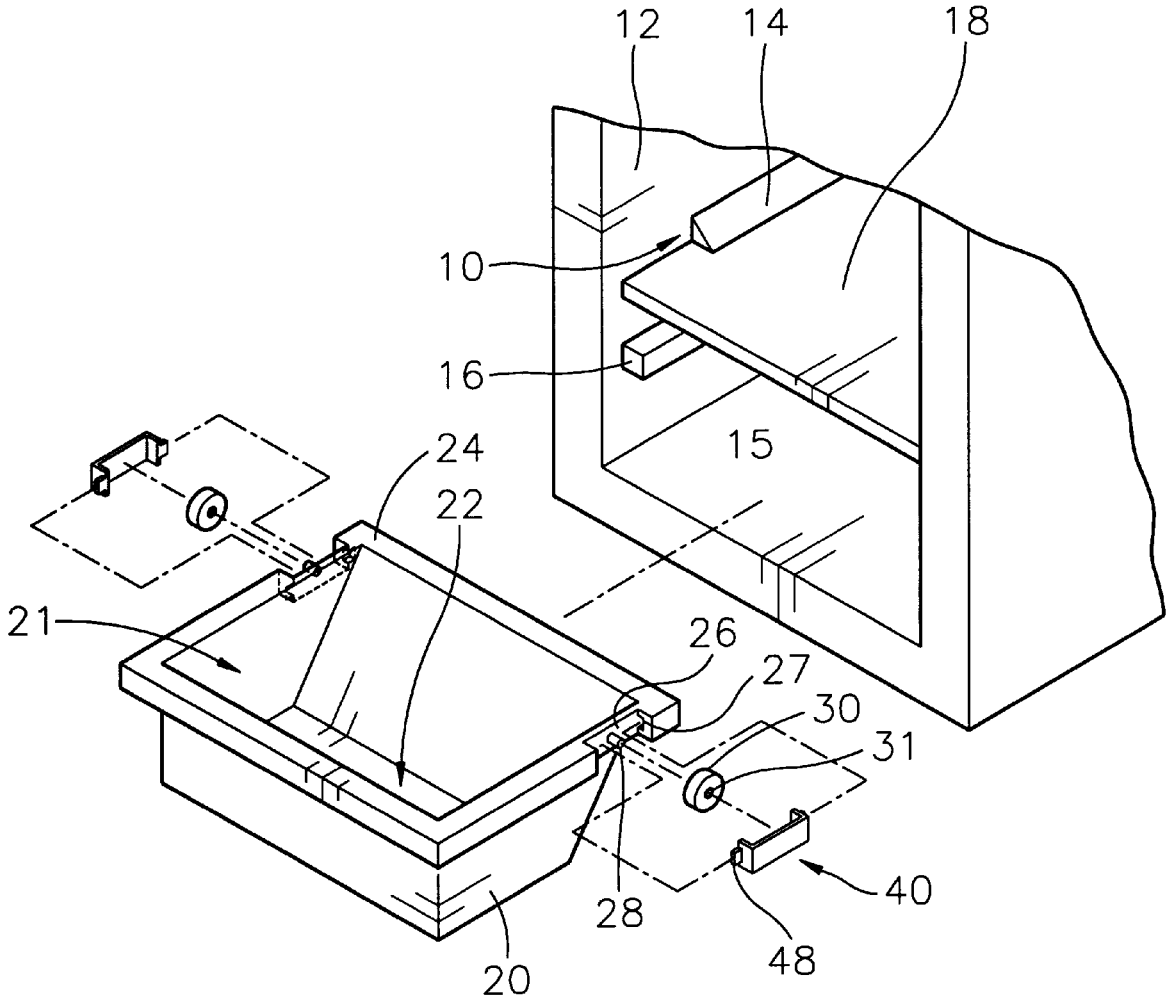
FIG. 1 (PRIOR ART)
FIG. 1 is an exploded perspective view showing a conventional refrigerator having a vegetable box.
Figure 2:
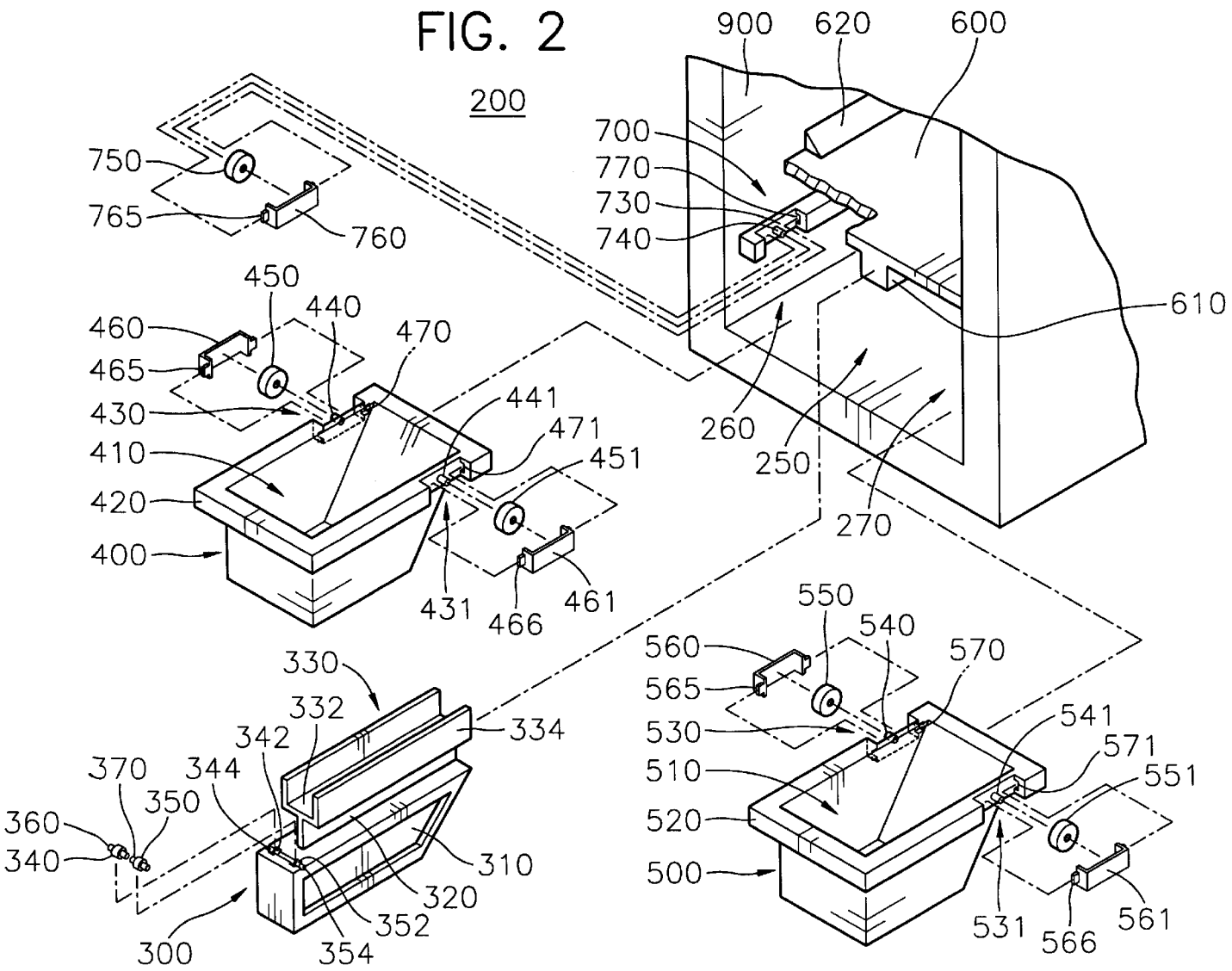
FIG. 2 is an exploded perspective view showing a foodstuff storing device for a refrigerator according to the present invention.

FIG. 2 shows a foodstuff storing device 200 for a refrigerator according to the present invention. A shelf 600 is provided at a predetermined position within a refrigerating compartment 900 for forming a vegetable compartment 250 at a lower portion of the refrigerating compartment 900. The shelf 600 is downwardly and protrudingly formed at the center portion of a lower surface thereof with a projection 610 which extends from a front end to a rear end of the shelf 600. According to the preferred embodiment of the present invention, the projection 610 has a rectangular cross-sectional shape.

A partition member 300 is provided in vegetable compartment 250 for separating the vegetable compartment 250 into a first chamber 260 and a second chamber 270 and is coupled to the projection 610. The partition member 300 comprises a coupling member 330 which is fixedly assembled with the projection 610, a supporting member 310 which is integrally formed at a lower end of the coupling member 330 and extends to a bottom wall of the refrigerating compartment 900 for separating the vegetable compartment 250 into the first and second chambers 260 and 270, and first and second rollers 340 and 350 which are rotatably mounted on a front portion of a top surface of the supporting member 310.

The coupling member 330 has a shape in correspondence to the shape of the projection 610 and consists of a horizontal part 332 and a vertical part 334 so as to be fixedly assembled with projection 610.

The supporting member 310 has a rectangular cross-sectional shape and extends from a front end to a rear end of refrigerating chamber 900. The top surface of the supporting member 310 is preferably flat. The supporting member 310 is formed at the front portion of the top surface thereof with first and second grooves 342 and 352 into which the first and second rollers 340 and 350 are rotatably installed. The first roller 340 is integrally formed at first and second sides thereof with rotating shafts 360 in which the second side is opposite to the first side. The first groove 342 is formed at first and second side walls thereof in which the second side wall is opposite to the first side wall with engagement grooves 344. The rotating shafts 360 of the first roller 340 are assembled into the engagement grooves 344 for rotatably supporting the first roller 340. The second roller 350 is integrally formed at third and fourth sides thereof, in which the fourth side is opposite to the third side, with rotating shafts 370. The second groove 352 is formed at a third side wall and a fourth side wall thereof, in which the fourth side wall is opposite to the third side wall, with engagement grooves 354. The rotating shafts 370 are assembled into the engagement grooves 354 for rotatably supporting the second roller 350.

First and second vegetable boxes 400 and 500 are slidably inserted into the first and second chambers 260 and 270 respectively. The first and the second vegetable boxes 400 and 500 are upwardly opened, and are integrally formed at upper edge portions thereof with first and second frames 420 and 520.

The construction of the first vegetable box 400 according to the present invention is as follows. The first frame 420 is formed at rear portions of both side walls thereof with grooves 430 and 431 which are positioned opposite to each other. The grooves 430 and 431 are provided at center positions thereof with horizontally and protrudingly formed shafts 440 and 441 respectively, and third and fourth rollers 450 and 451 are rotatably inserted around the shafts 440 and 441 respectively.

The grooves 430 and 431 are formed at both side walls thereof with latching grooves 470 and 471 respectively, and latches 460 and 461 having bending portions 465 and 466, respectively, are provided such that the bending portions 465 and 466 are latched to the latching grooves 470 and 471 respectively so as to be fixedly assembled to the first vegetable box 400, thereby preventing the third and fourth rollers 450 and 451 from separating from the shafts 440 and 441.

The construction of the second vegetable box 500 according to the present invention is the same as that of the first vegetable box 400. The second frame 520 is formed at rear portions of both side walls thereof with grooves 530 and 531 which are positioned opposite to each other and are provided at center positions thereof with horizontally and protrudingly formed shafts 540 and 541 respectively, and fifth and sixth rollers 550 and 551 are provided such that the fifth and sixth rollers 550 and 551 are rotatably inserted around the shafts 540 and 541 respectively.

The grooves 530 and 531 are formed at both side walls thereof with latching grooves 570 and 571 respectively, and latches 560 and 561 having bending portions 565 and 566 respectively are provided such that the bending portions 565 and 566 are latched to the latching grooves 570 and 571 respectively so as to be fixedly assembled to the second vegetable box 500, thereby preventing the fifth and sixth rollers 550 and 551 from separating from the shafts 540 and 541.

Meanwhile, a vertical plate 320 having a predetermined height is provided between the coupling member 330 and the supporting member 310 so that the coupling member 330 is spaced apart from the supporting member 310 by the predetermined height of the vertical plate 320 which is larger than the diameters of the fourth and fifth rollers 451 and 550, thereby permitting the fourth and fifth rollers 451 and 550 to rotate on the top surface of the supporting member and allowing the first and second boxes 400 and 500 to be slidably supported thereon.

First guiding member 700 and second guiding member (not shown) are provided at both side walls of the refrigerating compartment 900 below the shelf 600, and are positioned opposite to each other for guiding a sliding movement of the first and second vegetable boxes 400 and 500. Rollers are installed at the first and second guiding members. The first guiding member 700 is formed at a front portion thereof with a groove 730, and the groove 730 is provided at a center position thereof with a horizontally and protrudingly formed shaft 740. A seventh roller 750 is rotatably inserted around the shaft 740. The groove 730 is formed at both side walls thereof with latching grooves 770. Latch 760 having bending portions 765 is provided such that the bending portions 765 are latched to the latching grooves 770 so as to be fixedly assembled to the first guiding member 700, thereby preventing the seventh roller 750 from separating from the shaft 740.

The second guiding member has a structure substantially identical to the first guiding member 700, and is disposed opposite to the first guiding member 700.

Figure 3:
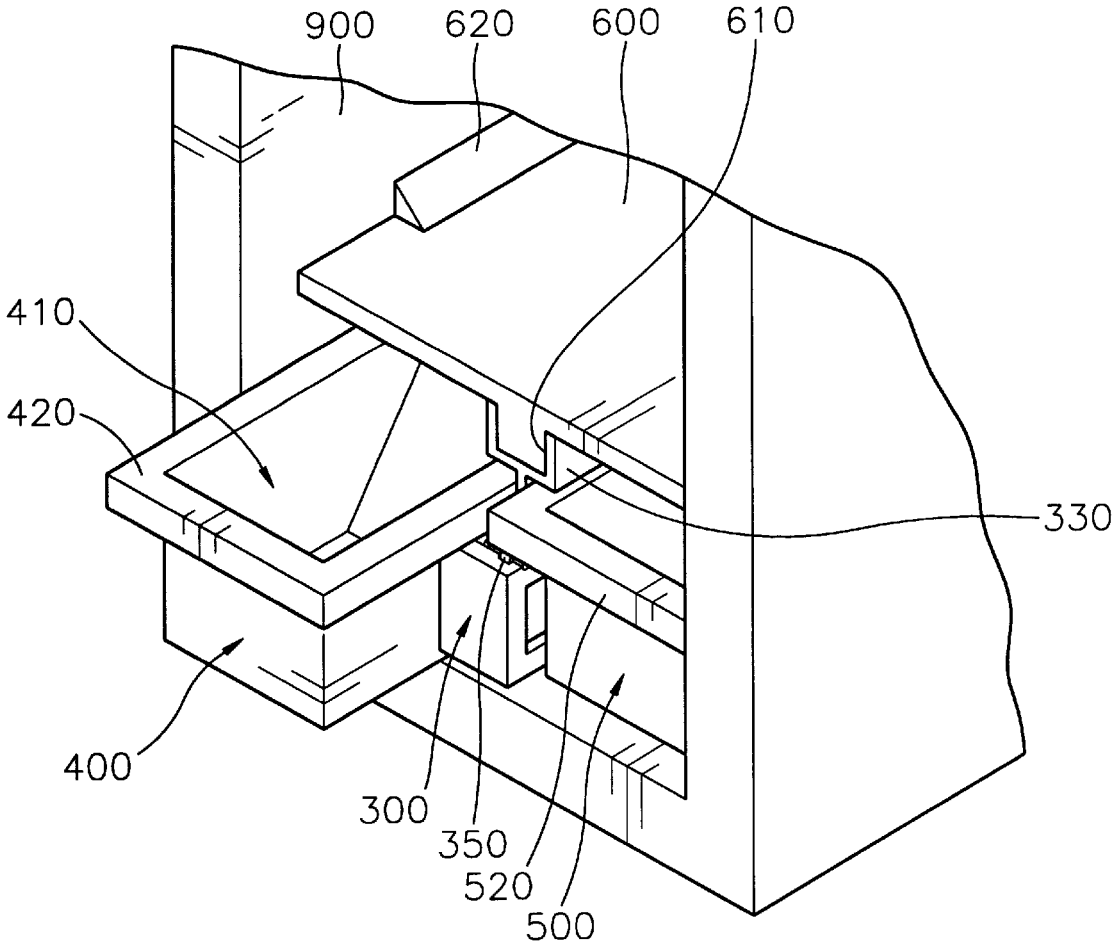
FIG. 3 is an operational perspective view showing the operation of the foodstuff storing device for a refrigerator according to the present invention.

Hereinafter, the operation of the foodstuff storing device for a refrigerator according to the present invention will be explained with reference to FIG. 3.

When the first vegetable box 400 is inserted/withdrawn into/from the vegetable compartment 250, the first roller 340 which is installed at the front portion of the top surface of supporting member 310 is rotated supporting a bottom surface of the first frame 420 which is adjacent to the partition member 300. The third roller 450 is rotated and guided along the top surface of the first guiding member 700. The fourth roller 451 is rotated along the top surface of the supporting member 310. The seventh roller 750 is rotated supporting a bottom surface of the first frame 420 which is adjacent to the inner wall of the refrigerating compartment 900. All of the above operations occur simultaneously, thereby facilitating a stable sliding movement of the first vegetable box 400. Also, when the second vegetable box 500 is inserted/withdrawn into/from the vegetable compartment 250, the second roller 350 which is installed at the front portion of the top surface of supporting member 310 is rotated supporting a bottom surfaces of the second frame 520 which is adjacent to the partition member 300. The sixth roller 551 is rotated and guided along the top surface of the second guiding member. The fifth roller 550 is rotated along the top surface of the supporting member 310. The eighth roller(not shown) is rotated supporting the bottom surface of the second frame 520 which is adjacent to the inner wall of the refrigerating compartment 900. All of the above operations are occur simultaneously, thereby facilitating a stable sliding movement of the second vegetable box 500.

As described above, the foodstuff storing device for a refrigerator according to the embodiment of the present invention can store different types of foodstuffs in separate vegetable boxes, thereby avoiding a contamination of the foodstuffs, and the vegetable boxes can be easily and stably inserted/withdrawn into/from the vegetable compartment 250.

Furthermore, the foodstuff storing device can efficiently maintain freshness of the foodstuffs by selectively drawing out the vegetable box storing a desired foodstuff.

Although the preferred embodiment of the invention has been described, it is understood that the present invention should not be limited to this preferred embodiment, but various changes and modifications can be made by one skilled in the art within the spirit and scope of the invention as hereinafter claimed.

What is claimed is:

1. A foodstuff storing device for a refrigerant having a refrigerating compartment therein, the device comprises:

a shelf provided at a first predetermined position within the refrigerating compartment for forming a vegetable compartment at a lower portion of the refrigerating compartment;

at least one projection which is downwardly and protrudingly formed at a second predetermined position of a lower surface of the shelf and extends from a front end to a rear end of the shelf;

a box section for storing a foodstuff, the box section being slidably inserted into the vegetable compartment;

at least one partition member for separating the vegetable compartment into at least two chambers, the partition member including a coupling member having a shape corresponding to a shape of the projection for being engaged with the projection, a supporting member integrally formed with the coupling member and extending downward to a bottom of the vegetable compartment for partitioning the vegetable compartment, and first and second rollers rotatably mounted on a front portion of a top surface of the supporting member so as to slidably support the box section which is slidably inserted in the chambers;

a first guiding member for guiding a sliding movement of the box section, the first guiding member being provided at a first inside wall of the refrigerating compartment below the shelf; and a second guiding member for guiding a sliding movement of the box section, the second guiding member being provided at a second inside wall of the refrigerating compartment below the shelf, the second inside wall being opposite to the first inside wall.

2. The device according to claim 1, wherein one projection is provided at a center portion of the shelf, one partition member is provided so that the vegetable compartment is separated into a first chamber and a second chamber, and the box section includes a first box and a second box which are slidably inserted into the first and the second chambers, respectively.

3. The device according to claim 2, wherein the first and the second boxes are upwardly opened, the first box is integrally formed at a first upper edge portion thereof with a first frame, and the second box is integrally formed at a second upper edge portion thereof with a second frame.

4. The device according to claim 3, wherein the supporting member is formed at the front portion of the top surface thereof with a first groove and a second groove, and the first and second rollers are rotatably installed in the first and second grooves.

5. The device according to claim 4, wherein the first roller is integrally formed at first and second sides thereof with first and second rotating shafts respectively, the second side being opposite to the first side, the first groove is formed at first and second side walls thereof with first and second engagement grooves respectively, the second side wall being opposite to the first side wall, the first and second rotating shafts are assembled into the first and second engagement grooves respectively for rotatably supporting the first roller, the second roller is integrally formed at third and fourth sides thereof with a third rotating shaft and a fourth rotating shaft respectively, the fourth side being opposite to the third side, the second groove is formed at a third side wall and a fourth side wall thereof with a third engagement groove and a fourth engagement groove respectively, the fourth side wall being opposite to the third side wall, and the third and the fourth rotating shafts are assembled into the third and the fourth engagement grooves respectively for rotatably supporting the second roller.

6. The device according to claim 3, wherein the first frame is formed at rear portions of first and second side walls thereof with first and second grooves respectively, the second side wall being opposite to the first side wall, the first and second grooves are provided at center positions thereof with horizontally and protrudingly formed first and second shafts respectively, a third roller and a fourth roller are provided such that the third and the fourth rollers are rotatably inserted around the first and second shafts, the second frame is formed at rear portions of third and fourth side walls thereof with third and fourth grooves respectively, the fourth side wall being opposite to the third side wall, the third and fourth grooves are provided at center portions thereof with horizontally and protrudingly formed third and fourth shafts respectively, and a fifth roller and a sixth roller are provided such that the fifth and the sixth rollers are rotatably inserted around the third and fourth shafts.

7. The device according to claim 6, wherein the first, second, third and fourth grooves are formed at both side walls thereof with first, second, third and fourth latching grooves respectively, and a first latch having a first bending portion, a second latch having a second bending portion, a third latch having a third bending portion and a fourth latch having a fourth bending portion are provided such that the first, second, third and fourth bending portions are latched to the first, second, third and fourth latching grooves respectively, thereby preventing the third, fourth, fifth and sixth rollers from separating from the first, second, third and fourth grooves.

8. The device according to claim 6, wherein the first and second guiding members are formed at front portions thereof with fifth and sixth grooves respectively, the sixth groove being opposite to the fifth groove, the fifth and sixth grooves are provided at center positions thereof with horizontally and protrudingly formed fifth and sixth shafts respectively, and seventh and eighth rollers are provided such that the seventh and eighth rollers are rotatably inserted around the fifth and sixth shafts respectively.

9. The device according to claim 8, wherein the fifth and sixth grooves are formed at both side walls thereof with first and second latching grooves respectively, and a first latch having a first bending portion and a second latch having a second bending portion are provided such that the first and second bending portions are latched to the first and second latching grooves respectively, thereby preventing the seventh and the eighth rollers from separating from the first and second grooves.

10. The device according to claim 8, wherein a vertical plate having a predetermined height is provided between the coupling member and the supporting member so that the coupling member is spaced apart from the supporting member by the predetermined height of the vertical plate, thereby permitting the fourth and fifth rollers to rotate along the top surface of the supporting member.

11. The device according to claim 10, wherein the first and second rollers support bottom surfaces of the first and second frames near the partition member respectively, the third roller is rotatably supported on the top surface of the first guiding member, the fourth and the fifth rollers are rotatably supported on the top surface of the supporting member, the sixth roller is rotatably supported on the top surface of the second guiding member, and the seventh and the eighth rollers support bottom surfaces of the first and the second frames near first and second inside walls respectively of the refrigerating chamber.

* * * * *